US009794715B2

(12) United States Patent
Walsh

(10) Patent No.: US 9,794,715 B2
(45) Date of Patent: Oct. 17, 2017

(54) SYSTEM AND METHODS FOR PROCESSING STEREO AUDIO CONTENT

(71) Applicant: DTS LLC, Calabasas, CA (US)

(72) Inventor: Martin Walsh, Scotts Valley, CA (US)

(73) Assignee: DTS LLC, Calabasas, CA (US)

( * ) Notice: Subject to any disclaimer, the term of this patent is extended or adjusted under 35 U.S.C. 154(b) by 301 days.

(21) Appl. No.: 14/201,655

(22) Filed: Mar. 7, 2014

(65) Prior Publication Data

US 2014/0270185 A1 Sep. 18, 2014

Related U.S. Application Data

(60) Provisional application No. 61/779,941, filed on Mar. 13, 2013.

(51) Int. Cl.
*H04R 5/00* (2006.01)
*H04S 5/00* (2006.01)
(Continued)

(52) U.S. Cl.
CPC ..... *H04S 5/00* (2013.01); *H04S 3/004* (2013.01); *H04S 3/02* (2013.01); *H04S 2400/01* (2013.01);
(Continued)

(58) Field of Classification Search
CPC ... H04S 5/00; H04S 3/004; H04S 3/02; H04S 2400/01; H04S 2400/05; H04S 2420/01
(Continued)

(56) References Cited

U.S. PATENT DOCUMENTS 2,511,482 A 6/1950 Shaper
3,745,674 A 7/1973 Thompson et al.
(Continued)

FOREIGN PATENT DOCUMENTS

EP 1089526 4/2001
EP 2124479 11/2009
(Continued)

OTHER PUBLICATIONS

International Preliminary Report on Patentability issued in application No. PCT/US2014/022131 on May 13, 2015.
(Continued)

*Primary Examiner* — Vivian Chin
*Assistant Examiner* — Ammar Hamid
(74) *Attorney, Agent, or Firm* — Knobbe, Martens, Olson & Bear, LLP

(57) ABSTRACT

A system can include a hardware processor that can receive left and right audio signals and process the left and right audio signals to generate three or more processed audio signals. The three or more processed audio signals can include a left audio signal, a right audio signal, and a center audio signal. The processor can also filter each of the left and right audio signals with one or more first virtualization filters to produce filtered left and right signals. The processor can also filter a portion of the center audio signal with a second virtualization filter to produce a filtered center signal. Further, the processor can combine the filtered left signal, filtered right signal, and filtered center signal to produce left and right output signals and output the filtered left and right output signals.

19 Claims, 15 Drawing Sheets

M-S Butterfly

(51) Int. Cl.
*H04S 3/00* (2006.01)
*H04S 3/02* (2006.01)

(52) U.S. Cl.
CPC ..... *H04S 2400/05* (2013.01); *H04S 2420/01* (2013.01)

(58) Field of Classification Search
USPC ..... 381/17, 60
See application file for complete search history.

(56) References Cited

U.S. PATENT DOCUMENTS 3,808,354 A 4/1974 Feezor et al.
3,809,811 A 5/1974 Delisle et al.
4,107,465 A 8/1978 Charlebois et al.
4,284,847 A 8/1981 Besserman
4,476,724 A 10/1984 Gotze
4,862,505 A 8/1989 Keith et al.
4,868,880 A 9/1989 Bennett
5,033,086 A 7/1991 Fidi
5,438,623 A 8/1995 Begault
5,579,396 A 11/1996 Iida et al.
5,737,389 A 4/1998 Allen et al.
5,785,661 A 7/1998 Shennib
5,825,894 A 10/1998 Shennib
5,870,481 A 2/1999 Dymond et al.
5,912,976 A 6/1999 Klayman et al.
6,086,541 A 7/2000 Rho
6,109,107 A 8/2000 Wright et al.
6,144,747 A 11/2000 Scofield et al.
6,167,138 A 12/2000 Shennib
6,212,496 B1 4/2001 Campbell et al.
6,319,207 B1 11/2001 Naidoo
6,322,521 B1 11/2001 Hou
6,343,131 B1 1/2002 Huopaniemi
6,379,314 B1 4/2002 Horn
6,428,485 B1 8/2002 Rho
6,457,362 B1 10/2002 Wright et al.
6,522,988 B1 2/2003 Hou
6,582,378 B1 6/2003 Nakaichi et al.
6,584,440 B2 6/2003 Litovsky
6,644,120 B1 11/2003 Braun et al.
6,707,918 B1 3/2004 McGrath et al.
6,724,862 B1 4/2004 Shaffer et al.
6,741,706 B1 5/2004 McGrath et al.
6,801,627 B1 10/2004 Kobayashi
6,813,490 B1 11/2004 Lang et al.
6,829,361 B2 12/2004 Aarts
6,840,908 B2 1/2005 Edwards et al.
6,913,578 B2 7/2005 Hou
6,928,179 B1 8/2005 Yamada et al.
6,970,569 B1 11/2005 Yamada
7,042,986 B1 5/2006 Lashley et al.
7,048,692 B2 5/2006 Nakaichi et al.
7,133,730 B1 11/2006 Katayama et al.
7,136,492 B2 11/2006 Moller
7,143,031 B1 11/2006 Ahroon
7,149,684 B1 12/2006 Ahroon
7,152,082 B2 12/2006 McGrath
7,162,047 B2 1/2007 Yamada et al.
7,167,571 B2 1/2007 Bantz et al.
7,181,297 B1 2/2007 Pluvinage et al.
7,184,557 B2 2/2007 Berson
7,190,795 B2 3/2007 Simon
7,206,416 B2 4/2007 Krause et al.
7,210,353 B2 5/2007 Braun et al.
7,221,765 B2 5/2007 Chalupper et al.
7,330,552 B1 2/2008 LaMance
7,333,863 B1 2/2008 Lydecker et al.
7,366,307 B2 4/2008 Yanz et al.
7,386,140 B2 6/2008 Ogata
7,440,575 B2 10/2008 Kirkeby
7,529,545 B2 5/2009 Rader et al.
7,536,021 B2 5/2009 Dickins et al.
7,539,319 B2 5/2009 Dickins et al.
7,564,979 B2 7/2009 Swartz
7,634,092 B2 12/2009 McGrath
7,680,465 B2 3/2010 Zad-Issa
7,715,575 B1 5/2010 Sakurai et al.
7,773,755 B2 8/2010 Terauchi
7,793,545 B2 9/2010 Mayou et al.
7,826,630 B2 11/2010 Yamada et al.
7,876,908 B2 1/2011 Hensel
7,933,419 B2 4/2011 Roeck et al.
7,936,887 B2 5/2011 Smyth
7,936,888 B2 5/2011 Kwon
7,949,141 B2 5/2011 Reilly et al.
7,978,866 B2 7/2011 Oteki
8,009,836 B2 8/2011 McGrath
8,059,833 B2 11/2011 Koh et al.
8,064,624 B2 11/2011 Neugebauer et al.
8,112,166 B2 2/2012 Pavlovic et al.
8,130,989 B2 3/2012 Latzel
8,135,138 B2 3/2012 Wessel et al.
8,144,902 B2 3/2012 Johnston
8,160,281 B2 4/2012 Kim et al.
8,161,816 B2 4/2012 Beck
8,166,312 B2 4/2012 Waldmann
8,195,453 B2 6/2012 Cornell et al.
8,196,470 B2 6/2012 Gross et al.
8,284,946 B2 10/2012 Moon et al.
8,340,303 B2 12/2012 Chun
8,358,786 B2 1/2013 Arora
2002/0068986 A1 6/2002 Mouline
2002/0076072 A1 6/2002 Cornelisse
2003/0028385 A1 2/2003 Christodoulou
2003/0070485 A1 4/2003 Johansen et al.
2003/0072455 A1 4/2003 Johansen et al.
2003/0073926 A1 4/2003 Johansen et al.
2003/0073927 A1 4/2003 Johansen et al.
2003/0101215 A1 5/2003 Puria et al.
2003/0123676 A1 7/2003 Schobben
2003/0223603 A1 12/2003 Beckman
2004/0049125 A1 3/2004 Nakamura
2005/0124375 A1 6/2005 Nowosielski
2005/0135644 A1 6/2005 Qi
2005/0148900 A1 7/2005 Braun et al.
2006/0045281 A1 3/2006 Korneluk
2006/0083394 A1* 4/2006 McGrath ..... H04S 3/00 381/309
2006/0215844 A1 9/2006 Voss
2007/0003077 A1 1/2007 Pedersen et al.
2007/0071263 A1 3/2007 Beck
2007/0129649 A1 6/2007 Thornton et al.
2007/0189545 A1 8/2007 Geiger et al.
2007/0204696 A1 9/2007 Braun et al.
2008/0002845 A1 1/2008 Imaki
2008/0008328 A1 1/2008 Hansson
2008/0049946 A1 2/2008 Heller et al.
2008/0167575 A1 7/2008 Cronin et al.
2008/0269636 A1 10/2008 Burrows et al.
2008/0279401 A1 11/2008 Bharitkar et al.
2008/0316879 A1 12/2008 Sako et al.
2009/0013787 A1 1/2009 Esnouf
2009/0116657 A1 5/2009 Edwards et al.
2009/0156959 A1 6/2009 Thornton et al.
2009/0268919 A1 10/2009 Arora
2010/0056950 A1 3/2010 Banerjee et al.
2010/0056951 A1 3/2010 Banerjee et al.
2010/0098262 A1 4/2010 Frohlich
2010/0119093 A1 5/2010 Uzuanis et al.
2010/0137739 A1 6/2010 Lee et al.
2010/0166238 A1 7/2010 Lee et al.
2010/0183161 A1 7/2010 Boretzki
2010/0191143 A1 7/2010 Ganter et al.
2010/0215199 A1 8/2010 Breebaart
2010/0272297 A1 10/2010 Boretzki
2010/0310101 A1 12/2010 Anderson
2010/0316227 A1 12/2010 Schmid
2010/0329490 A1 12/2010 Van Schijndel et al.
2011/0009771 A1 1/2011 Guillon et al.
2011/0046511 A1 2/2011 Koo et al.
2011/0075853 A1 3/2011 Anderson et al.

(56) References Cited

U.S. PATENT DOCUMENTS

| | | | | |
|---|---|---|---|---|
| 2011/0091046 | A1* | 4/2011 | Villemoes | G10L 19/008 381/22 |
| 2011/0106508 | A1 | 5/2011 | Boretzki | |
| 2011/0190658 | A1 | 8/2011 | Sohn et al. | |
| 2011/0211702 | A1* | 9/2011 | Mundt | H04S 3/004 381/17 |
| 2011/0219879 | A1 | 9/2011 | Chalupper et al. | |
| 2011/0280409 | A1 | 11/2011 | Michael et al. | |
| 2011/0305358 | A1 | 12/2011 | Nishio et al. | |
| 2012/0051569 | A1 | 3/2012 | Blamey et al. | |
| 2012/0057715 | A1 | 3/2012 | Johnston et al. | |
| 2012/0063616 | A1 | 3/2012 | Walsh et al. | |
| 2012/0099733 | A1 | 4/2012 | Wang et al. | |
| 2012/0134521 | A1 | 5/2012 | Wessel et al. | |
| 2012/0157876 | A1 | 6/2012 | Bang et al. | |
| 2012/0288124 | A1 | 11/2012 | Fejzo et al. | |

FOREIGN PATENT DOCUMENTS

| | | |
|---|---|---|
| WO | WO 97/25834 | 7/1997 |
| WO | WO 01/24576 | 4/2001 |
| WO | WO 2004/039126 | 5/2004 |
| WO | WO 2004/104761 | 12/2004 |
| WO | WO 2006/002036 | 1/2006 |
| WO | WO 2006/007632 | 1/2006 |
| WO | WO 2006/136174 | 12/2006 |
| WO | WO 2010/017156 | 2/2010 |
| WO | WO 2010/139760 | 12/2010 |
| WO | WO 2011/014906 | 2/2011 |
| WO | WO 2011/026908 | 3/2011 |
| WO | WO 2011/039413 | 4/2011 |
| WO | WO 2012/016527 | 2/2012 |

OTHER PUBLICATIONS

Written Opinion issued in application No. PCT/US2014/022131 on Feb. 16, 2015.

International Search Report and Written Opinion issued in application No. PCT/US2013/072108 on Apr. 14, 2014.

International Search Report and Written Opinion issued in application No. PCT/US2014/022131 on May 16, 2014.

Boothroyd et al. Video-game for Speech Perception Testing and Training of Young Hearing-impaired Children, Jan. 1992, Graduate School, City of University of New York.

Ninadvorko et al. "Audio-visual perception of video and multimedia programs", Audio Engineering Society, presented al the 21 st Conference, Jun. 1-3, 2002, St. Petersburg, Russia.

Usher et al. "Visualizing auditory spatial imagery of multi-channel audio", Audio Engineering Society, Presented at the 116th Convention, May 8-11, 2004, Berlin, Germany.

U.S. Appl. No. 14/091,112, Entitled Method and Apparatus for Personalized Audio Virtualization, filed Nov. 26, 2013.

* cited by examiner

SYSTEM AND METHODS FOR PROCESSING STEREO AUDIO CONTENT

RELATED APPLICATION

This application is a nonprovisional of U.S. Provisional Application No. 61/779,941, filed Mar. 13, 2013, the disclosure of which is hereby incorporated by reference in its entirety.

BACKGROUND

Stereophonic reproduction occurs when a sound source (such as an orchestra) is recorded on two different sound channels by one or more microphones. Upon reproduction by a pair of loudspeakers, the sound source does not appear to emanate from a single point between the loudspeakers, but instead appears to be distributed throughout and behind the plane of the two loudspeakers. The two-channel recording provides for the reproduction of a sound field which enables a listener to both locate various sound sources (e.g., individual instruments or voices) and to sense the acoustical character of the recording room. Two channel recordings are also often made using a single microphone with post-processing using pan-pots, stereo studio panners, or the like.

Regardless, true stereophonic reproduction is characterized by two distinct qualities that distinguish it from single-channel reproduction. The first quality is the directional separation of sound sources to produce the sensation of width. The second quality is the sensation of depth and presence that it creates. The sensation of directional separation has been described as that which gives the listener the ability to judge the selective location of various sound sources, such as the position of the instruments in an orchestra. The sensation of presence, on the other hand, is the feeling that the sounds seem to emerge, not from the reproducing loudspeakers themselves, but from positions in between and usually somewhat behind the loudspeakers. The latter sensation gives the listener an impression of the size, acoustical character, and the depth of the recording location. The term "ambience" has been used to describe the sensation of width, depth, and presence. Two-channel stereophonic sound reproduction preserves both qualities of directional separation and ambience.

SUMMARY

In certain embodiments, a method includes (under control of a hardware processor) receiving left and right audio channels, combining at least a portion of the left audio channel with at least a portion of the right audio channel to produce a center channel, deriving left and right audio signals at least in part from the center channel, and applying a first virtualization filter comprising a first head-related transfer function to the left audio signal to produce a virtualized left channel. The method can also include applying a second virtualization filter including a second head-related transfer function to the right audio signal to produce a virtualized right channel, applying a third virtualization filter including a third head-related transfer function to a portion of the center channel to produce a phantom center channel, mixing the phantom center channel with the virtualized left and right channels to produce left and right output signals, and outputting the left and right output signals to headphone speakers for playback over the headphone speakers.

The method of the previous paragraph can be used in conjunction with any subcombination of the following features: applying first and second gains to the center channel to produce a first scaled center channel and a second scaled center channel; using the second scaled center channel to perform said deriving; and values of the first and second gains can be linked based on amplitude or energy.

In other embodiments, a method includes (under control of a hardware processor) processing a two channel audio signal including two audio channels to generate three or more processed audio channels, where the three or more processed audio channels include a left channel, a right channel, and a center channel. The center channel can be derived from a combination of the two audio channels of the two channel audio signal. The method can also include applying each of the processed audio channels to the input of a virtualization system, applying one or more virtualization filters of the virtualization system to the left channel, the right channel, and a portion of the center channel, and outputting a virtualized two channel audio signal from the virtualization system.

The method of the previous paragraph can be used in conjunction with any subcombination of the following features: processing the two channel audio signal can further include deriving the left channel and the right channel at least in part from the center channel; further including applying first and second gains to the center channel to produce a first scaled center channel and a second scaled center channel, where the processing further includes deriving the left and right channels from the second scaled center channel; values of the first and second gains can be linked; values of the first and second gains can be linked based on amplitude; and values of the first and second gains can be linked based on energy.

In certain embodiments, a system can include a hardware processor that can receive left and right audio signals and process the left and right audio signals to generate three or more processed audio signals. The three or more processed audio signals can include a left audio signal, a right audio signal, and a center audio signal. The processor can also filter each of the left and right audio signals with one or more first virtualization filters to produce filtered left and right signals. The processor can also filter a portion of the center audio signal with a second virtualization filter to produce a filtered center signal. Further, the processor can combine the filtered left signal, filtered right signal, and filtered center signal to produce left and right output signals and output the filtered left and right output signals.

The system of the previous paragraph can be used in conjunction with any subcombination of the following features: the one or more virtualization filters can include two head-related impulse responses for each of the three or more processed audio signals; the one or more virtualization filters can include a pair of ipsilateral and contralateral head-related transfer functions for each of the three or more processed audio signals; the three or more processed audio signals can include five processed audio signals, and wherein the hardware processor is further configured to filter each of the five processed signals; the hardware processor can apply at least the following filters to the five processed signals: a left front filter, a right front filter, a center filter, a left surround filter, and a right surround filter; the hardware processor can apply gains to at least some of the inputs to the left front filter, the right front filter, the left surround filter, and the right surround filter; values of the gains can be linked; values of the gains can be linked based on amplitude; values of the gains can be linked based on energy; the three or more processed audio signals can include six processed audio signals and the hardware processor can filter five of the six processed signals; the six processed audio signals can include two center channels; and the hardware processor filters only one of the two center channels in one embodiment.

For purposes of summarizing the disclosure, certain aspects, advantages and novel features of the inventions have been described herein. It is to be understood that not necessarily all such advantages may be achieved in accordance with any particular embodiment of the inventions disclosed herein. Thus, the inventions disclosed herein may be embodied or carried out in a manner that achieves or optimizes one advantage or group of advantages as taught herein without necessarily achieving other advantages as may be taught or suggested herein.

BRIEF DESCRIPTION OF THE DRAWINGS

Throughout the drawings, reference numbers may be re-used to indicate correspondence between referenced elements. The drawings are provided to illustrate embodiments described herein and not to limit the scope thereof.

DETAILED DESCRIPTION

I. Introduction

Figure 1:
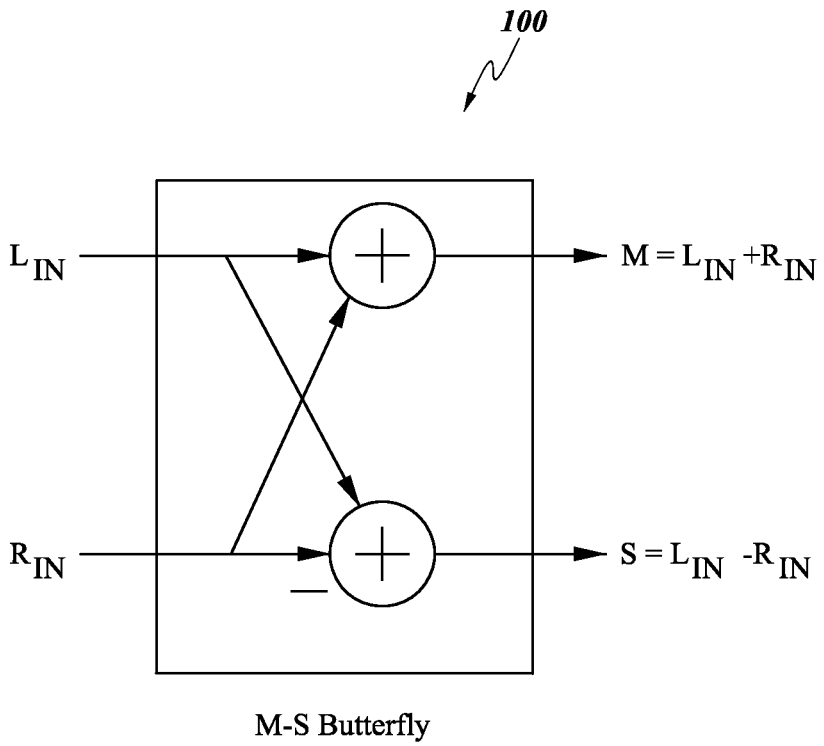
FIG. 1 illustrates a conventional stereo M-S butterfly matrix.

The detailed description set forth below in connection with the appended drawings is intended as a description of various embodiments, and is not intended to represent the only form in which the embodiments disclosed herein may be constructed or utilized. The description sets forth various example functions and sequence of steps for developing and operating various embodiments. It is to be understood, however, that the same or equivalent functions and sequences may be accomplished by different embodiments. It is further understood that the use of relational terms such as first and second and the like are used solely to distinguish one from another entity without necessarily requiring or implying any actual such relationship or order between such entities.

Embodiments described herein concern processing audio signals, including signals representing physical sound. These signals can be represented by digital electronic signals. In the discussion which follows, analog waveforms may be shown or discussed to illustrate the concepts; however, it should be understood that some embodiments operate in the context of a time series of digital bytes or words, said bytes or words forming a discrete approximation of an analog signal or (ultimately) a physical sound. The discrete, digital signal corresponds to a digital representation of a periodically sampled audio waveform. In an embodiment, a sampling rate of approximately 44.1 kHz may be used. Higher sampling rates such as 96 khz may alternatively be used. The quantization scheme and bit resolution can be chosen to satisfy the requirements of a particular application. The techniques and apparatus described herein may be applied interdependently in a number of channels. For example, they can be used in the context of a surround audio system having more than two channels.

As used herein, a "digital audio signal" or "audio signal" does not describe a mere mathematical abstraction, but, in addition to having its ordinary meaning, denotes information embodied in or carried by a physical medium capable of detection by a machine or apparatus. This term includes recorded or transmitted signals, and should be understood to include conveyance by any form of encoding, including pulse code modulation (PCM), but not limited to PCM. Outputs or inputs, or indeed intermediate audio signals could be encoded or compressed by any of various known methods, including MPEG, ATRAC, AC3, or the proprietary methods of DTS, Inc. as described in U.S. Pat. Nos. 5,974,380; 5,978,762; and 6,487,535. Some modification of the calculations may be performed to accommodate that particular compression or encoding method.

Embodiments described herein may be implemented in a consumer electronics device, such as a DVD or BD player, TV tuner, CD player, handheld player, Internet audio/video device, a gaming console, a mobile phone, headphones, or the like. A consumer electronic device can include a Central Processing Unit (CPU), which may represent one or more types of processors, such as an IBM PowerPC, Intel Pentium (x86) processors, and so forth. A Random Access Memory (RAM) temporarily stores results of the data processing operations performed by the CPU, and may be interconnected thereto typically via a dedicated memory channel. The consumer electronic device may also include permanent storage devices such as a hard drive, which may also be in communication with the CPU over an I/O bus. Other types of storage devices such as tape drives or optical disk drives may also be connected. A graphics card may also be connected to the CPU via a video bus, and transmits signals representative of display data to the display monitor. External peripheral data input devices, such as a keyboard or a mouse, may be connected to the audio reproduction system over a USB port. A USB controller can translate data and instructions to and from the CPU for external peripherals connected to the USB port. Additional devices such as printers, microphones, speakers, headphones, and the like may be connected to the consumer electronic device.

The consumer electronic device may utilize an operating system having a graphical user interface (GUI), such as WINDOWS from Microsoft Corporation of Redmond, Wash., MAC OS from Apple, Inc. of Cupertino, Calif., various versions of mobile GUIs designed for mobile operating systems such as Android, and so forth. The consumer electronic device may execute one or more computer programs. Generally, the operating system and computer programs are tangibly embodied in a computer-readable medium, e.g. one or more of the fixed and/or removable data storage devices including the hard drive. Both the operating system and the computer programs may be loaded from the aforementioned data storage devices into the RAM for execution by the CPU. The computer programs may comprise instructions which, when read and executed by the CPU, cause the same to perform the steps to execute the steps or features of embodiments described herein.

Embodiments described herein may have many different configurations and architectures. Any such configuration or architecture may be readily substituted. A person having ordinary skill in the art will recognize the above described sequences are the most commonly utilized in computer-readable mediums, but there are other existing sequences that may be substituted.

Elements of one embodiment may be implemented by hardware, firmware, software or any combination thereof. When implemented as hardware, embodiments described herein may be employed on one audio signal processor or distributed amongst various processing components. When implemented in software, the elements of an embodiment can include the code segments to perform the necessary tasks. The software can include the actual code to carry out the operations described in one embodiment or code that emulates or simulates the operations. The program or code segments can be stored in a processor or machine accessible medium or transmitted by a computer data signal embodied in a carrier wave, or a signal modulated by a carrier, over a transmission medium. The processor readable or accessible medium or machine readable or accessible medium may include any medium that can store, transmit, or transfer information. In contrast, a computer-readable storage medium or non-transitory computer storage can include a physical computing machine storage device but does not encompass a signal.

Examples of the processor readable medium include an electronic circuit, a semiconductor memory device, a read only memory (ROM), a flash memory, an erasable ROM (EROM), a floppy diskette, a compact disk (CD) ROM, an optical disk, a hard disk, a fiber optic medium, a radio frequency (RF) link, etc. The computer data signal may include any signal that can propagate over a transmission medium such as electronic network channels, optical fibers, air, electromagnetic, RF links, etc. The code segments may be downloaded via computer networks such as the Internet, Intranet, etc. The machine accessible medium may be embodied in an article of manufacture. The machine accessible medium may include data that, when accessed by a machine, cause the machine to perform the operation described in the following. The term "data," in addition to having its ordinary meaning, here refers to any type of information that is encoded for machine-readable purposes. Therefore, it may include program, code, a file, etc.

All or part of various embodiments may be implemented by software executing in a machine, such as a hardware processor comprising digital logic circuitry. The software may have several modules coupled to one another. A software module can be coupled to another module to receive variables, parameters, arguments, pointers, etc. and/or to generate or pass results, updated variables, pointers, etc. A software module may also be a software driver or interface to interact with the operating system running on the platform. A software module may also include a hardware driver to configure, set up, initialize, send, or receive data to and from a hardware device.

Various embodiments may be described as one or more processes, which may be depicted as a flowchart, a flow diagram, a structure diagram, or a block diagram. Although a block diagram may describe the operations as a sequential process, many of the operations can be performed in parallel or concurrently. In addition, the order of the operations may be re-arranged. A process is terminated when its operations are completed. A process may correspond to a method, a program, a procedure, or the like.

II. Issues in Current Stereo Virtualization Techniques

When conventional stereo audio content is played back over headphones, the listener may experience various phenomena that negatively impact the listening experience, including in-head localization and listener fatigue. This may be caused by the way in which the stereo audio content is mastered or mixed. Stereo audio content is often mastered for stereo loudspeakers positioned in front of the listener, and may include extreme panning of some audio components to the left or right loudspeakers. When this audio content is played back over headphones, the audio content may sound as if it is being played from inside of the listeners head, and the extreme panning of some audio components may be fatiguing or unnatural for the listener. A conventional method of improving the headphone listening experience with stereo audio content is to virtualize stereo loudspeakers.

Conventional stereo virtualization techniques involve the processing of two-channel stereo audio content for playback over headphones. The audio content is processed to give a listener the impression that the audio content is being played through loudspeakers in front of the listener, and not through headphones. However, conventional stereo virtualization techniques often fail to provide a satisfactory listening experience.

One issue often associated with conventional stereo virtualization techniques is that center-panned audio components, such as voice, may lose their presence and may appear softer or weaker when the left and right channels are processed for loudspeaker virtualization. To alleviate this effect, some conventional stereo virtualization algorithms attempt to extract the center panned audio components and redirect them to a virtualized center channel loudspeaker, in concert with the traditional left and right virtualized loudspeakers.

Conventional methods of extracting a center channel from a left/right stereo audio signal include simple addition of the left and right audio signals, or more sophisticated frequency domain extraction techniques which attempt to separate the center-panned content from the rest of the stereo signal in an energy preserving manner. Addition of the left and right channels is an easy-to-implement center channel extraction solution; however since this technique is not energy preserving, the resulting virtualized stereo sound field may sound unbalanced when the audio content is played back. For example, the center-panned audio components may receive too much emphasis, and/or the audio components panned to the extreme left or right may have poor imaging. Frequency domain center-channel extraction may produce an improved stereo sound field; however these kinds of techniques usually require much greater processing power to implement.

The prevalence of headphone listening is another issue negatively impacting conventional stereo virtualization techniques. Traditional stereo loudspeaker listening is no longer a common listening experience for many listeners. Therefore, emulating a stereo loudspeaker listening experience does not provide a satisfying listening experience for many headphone-wearing listeners. For these listeners, an unprocessed stereo signal received at the headphone is the quality reference they are used to, and any changes to that reference's spectrum or phase is assumed to be deleterious, even when the processing accurately matches the stereo mixing and mastering setup.

III. Audio Content Processing Examples

FIG. 1 illustrates a conventional stereo M-S butterfly matrix 100. A left channel signal "$L_{IN}$" and a right channel signal "$R_{IN}$" are input into the matrix 100. The $L_{IN}$ signal is added to the $R_{IN}$ signal to generate a mid signal "M" output, and the $R_{IN}$ signal is subtracted from the $L_{IN}$ signal to generate a side signal "S" output.

Figure 2:
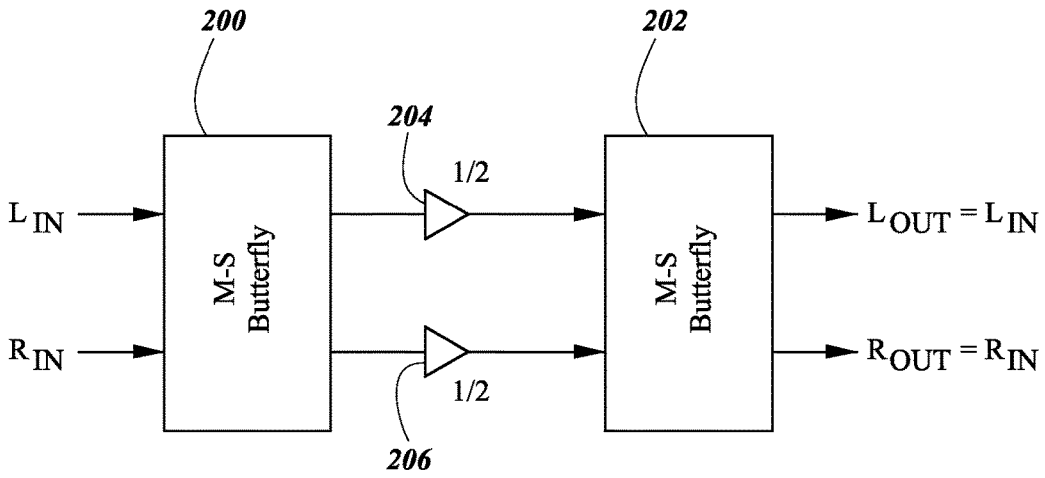
FIG. 2 illustrates a pair of conventional stereo M-S butterfly matrices placed in series.

FIG. 2 illustrates a pair of conventional stereo M-S butterfly matrices 200 and 202 placed in series. The M and S outputs of the first M-S butterfly matrix 200 are connected to two scalars 204 and 206. The scalars 204 and 206 reduce the gain of the first M and S outputs by half. The reduced signals are then input into the second M-S butterfly matrix 202. The combination of two M-S butterfly matrices in series with ½ scalars results in the outputs ($L_{OUT}$ and $R_{OUT}$) of the second M-S butterfly matrix 202 equaling the original right channel input signal $R_{IN}$ and left channel input signal $L_{IN}$.

Figure 3:
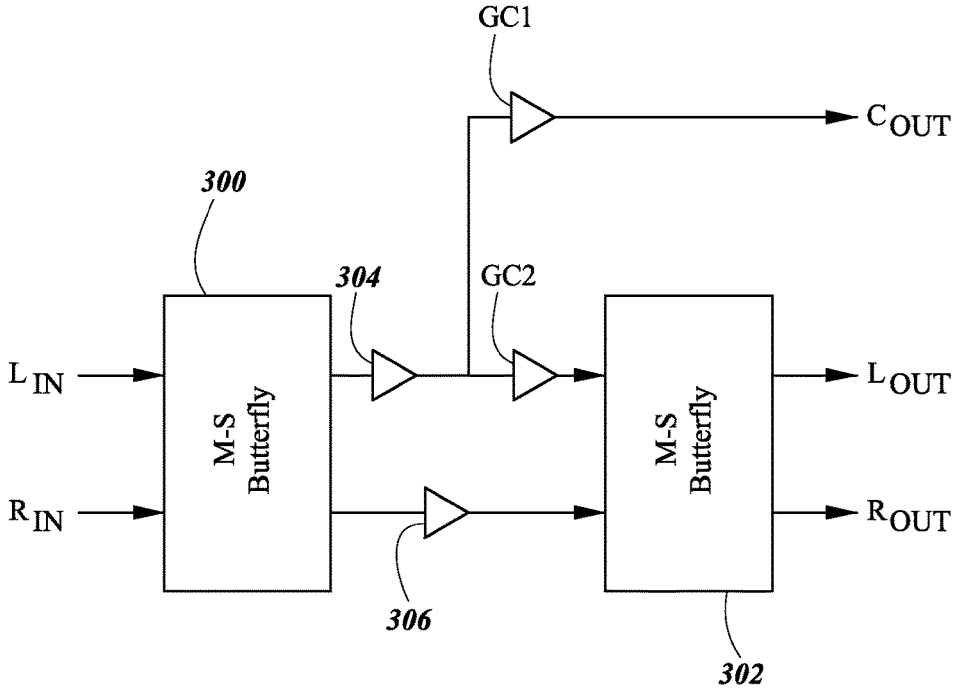
FIG. 3 illustrates an embodiment of a modified pair of stereo M-S butterfly matrices.

FIG. 3 illustrates an embodiment of a modified pair of stereo M-S butterfly matrices 300 and 302. As in FIG. 2, the M and S outputs of the first M-S butterfly matrix 300 are connected to two scalars 304 and 306. The scalars 304 and 306 may have a value of ½, or may be adjusted to other values. After the gain is adjusted by the mid "M" output scalar 304, the signal is directed through two center scalars GC1 and GC2. The result of the first center scalar GC1 is output as a dedicated center channel signal $C_{OUT}$ The result of the second center scalar GC2 is input to the second M-S butterfly matrix 302. The second M-S butterfly matrix 302 outputs a left channel signal $L_{OUT}$ and a right channel signal $R_{OUT}$.

In accordance with a particular embodiment, the values of the two center scalars GC1 and GC2 are linked. The values may be chosen so that the total amplitude of GC1 and GC2 equals one (i.e., GC1+GC2=1), or the values may be chosen so that the total energy of GC1 and GC2 equals one (i.e., $\sqrt{GC1^2+GC2^2}=1$). The values of GC1 and GC2 determine how much of the audio signal is directed to the dedicated center channel $C_{OUT}$ and how much remains as a "phantom" center channel (i.e., a component of $L_{OUT}$ and $R_{OUT}$). A smaller GC1 can mean that more of the audio signal is directed to a phantom center channel, while a smaller GC2 mean more of the audio signal is directed to the dedicated center channel $C_{OUT}$. The $C_{OUT}$, $L_{OUT}$, and $R_{OUT}$ signals may then be connected to loudspeakers arranged in center, left, and right locations for playback of the audio content. In another embodiment, the $C_{OUT}$, $L_{OUT}$, and $R_{OUT}$ signals may be processed further, as described below.

Figure 4:
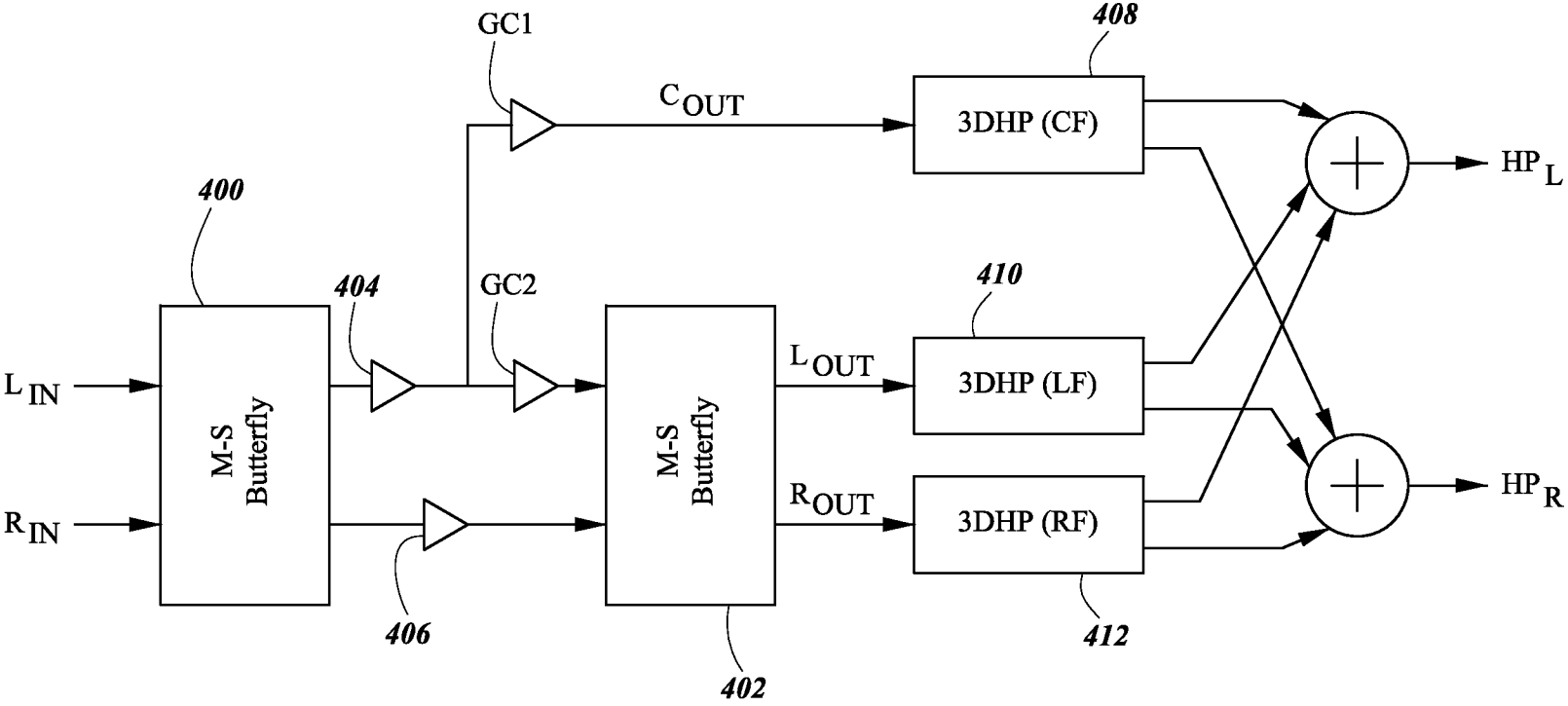
FIG. 4 illustrates an embodiment of a headphone virtualization system.

FIG. 4 illustrates an embodiment of a headphone virtualization system. The headphone virtualization system includes an input stage as shown in FIG. 3. The input stage includes a pair of M-S butterfly matrices 400 and 402, M and S scalars 404 and 406, and two center scalars GC1 and GC2. The center channel signal $C_{OUT}$ from the input stage is fed to a center filter 408. The left channel signal $L_{OUT}$ from the input stage is fed to a left front filter 410. The right channel signal $R_{OUT}$ from the input stage is fed to a right front filter 412. The outputs of the center filter 408, left front filter 410, and right front filter 412 are then combined into a left headphone signal $HP_L$ and a right headphone signal $HP_R$. The left headphone signal $HP_L$ and the right headphone signal $HP_R$ may then be connected to headphones for playback of the audio content.

The center, left front, and right front filters (408, 410, 412) utilize head related transfer functions (HRTFs) to give a listener the impression that the audio signals are emanating from certain virtual locations when the audio signals are played back over headphones. The virtual locations may correspond to any loudspeaker layout, such as a standard 3.1 speaker layout. The center filter 408 filters the center channel signal $C_{OUT}$ to sound as if it is emanating from a center speaker in front of the listener. The left front filter 410 filters the left channel signal $L_{OUT}$ to sound as if it is emanating from a speaker in front and to the left of the listener. The right front filter 412 filters the right channel signal $R_{OUT}$ to sound as if it is emanating from a speaker in front and to the right of the listener. The center, left front, and right front (408, 410, 412) filters may utilize a topology similar to the example topology described below in relation to FIG. 4A.

Figure 4A:
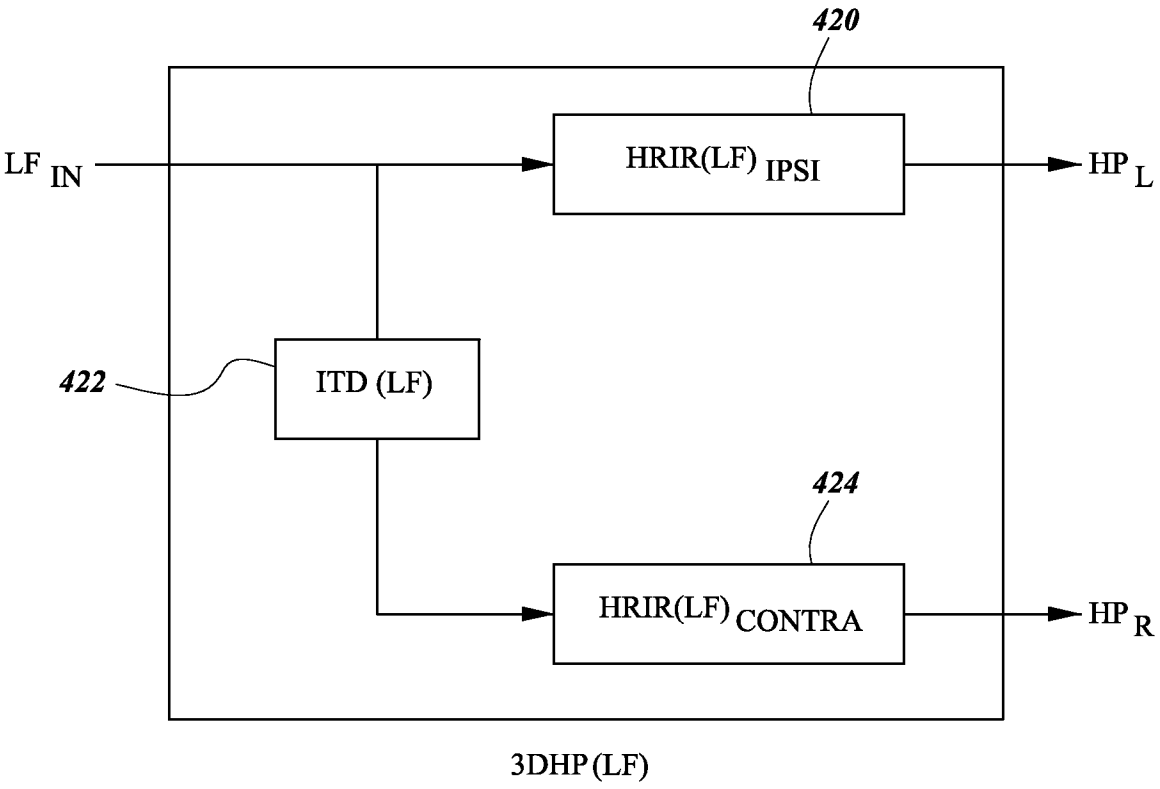
FIG. 4A illustrates an example of a left front filter.

FIG. 4A illustrates an example of a left front filter. The left front filter receives an input signal $LF_{IN}$. The input signal $LF_{IN}$ is filtered by an ipsilateral head-related impulse response (HRIR) 420. The result of the ipsilateral HRIR 420 is output as a component of the left headphone signal $HP_L$. The input signal $LF_{IN}$ is also delayed by an inter-aural time difference (ITD) 422. The delayed signal is then filtered by a contralateral HRIR 424. The result of the contralateral HRIR 424 is output as a component of the right headphone signal $HP_R$. One of ordinary skill in the art would recognize that the ipsilateral HRIR 420, ITD 422, and contralateral HRIR 424 may be easily modified and rearranged to create other filters, such as right front, center, left surround, and right surround filters. The ipsilateral HRIR 420 and contralateral HRIR 424 are preferably minimum phase. The minimum phase can help to avoid audible comb filter effects caused by time delays between center, left front, right front, left surround, and right surround filters. While the example filter of FIG. 4A utilizes HRIRs with minimum phase, binaural room responses may be used as an alternative to HRIRs.

Figure 5:
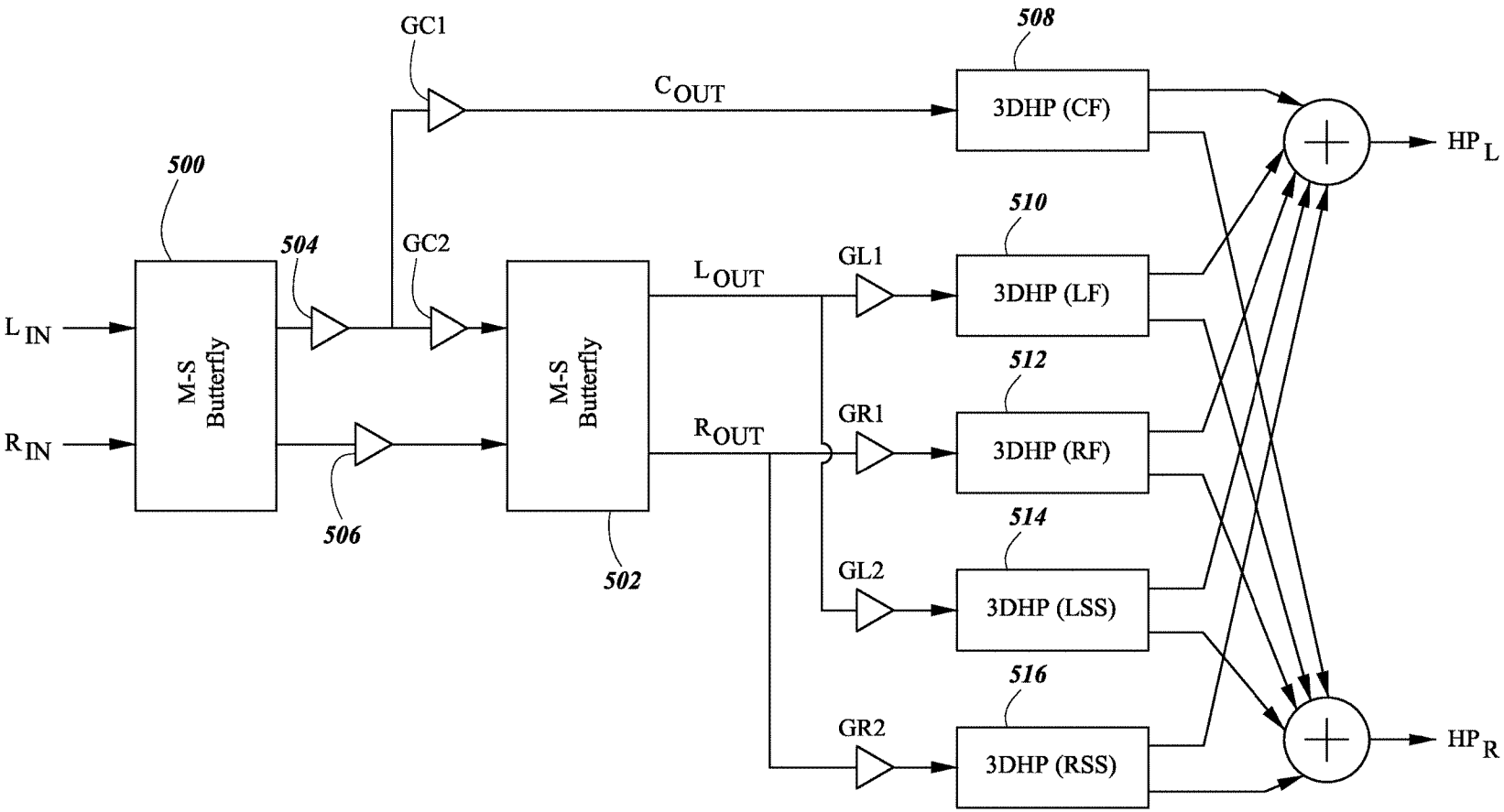
FIG. 5 illustrates another embodiment of a headphone virtualization system.

FIG. 5 illustrates another embodiment of a headphone virtualization system. The system of FIG. 5 can allow audio components that were hard-panned to the left or right to emanate more to the sides of the listener. This arrangement can better emulate the panning trajectories a headphone listener expects to hear. The system of FIG. 5 includes an input stage as shown in FIGS. 3 and 4. The input stage includes a pair of M-S butterfly matrices 500 and 502, M and S scalars 504 and 506, and two center scalars GC1 and GC2. The center channel signal $C_{OUT}$ from the input stage is fed to a center filter 508. The left channel signal $L_{OUT}$ from the input stage is directed to two left scalars GL1 and GL2. The result of the first left scalar GL1 is fed to a left front filter 510, and the result of the second left scalar GL2 is fed to a left surround filter 514. The right channel signal $R_{OUT}$ from the input stage is directed to two right scalars GR1 and GR2. The result of the first right scalar GR1 is fed to a right front filter 512, and the result of the second right scalar GR2 is fed to a right surround filter 516. The outputs of the center filter 508, left front filter 510, right front filter 512, left surround filter 514, and right surround filter 516 are then combined into a left headphone signal $HP_L$ and a right headphone signal $HP_R$. The left headphone signal $HP_L$ and the right headphone signal $HP_R$ may then be connected to headphones or other loudspeakers for playback of the audio content.

The center, left front, right front, left surround, and right surround filters (508, 510, 512, 514, 516) utilize HRTFs to give a listener the impression that the audio signals are emanating from certain virtual locations when the audio signals are played back over headphones. The virtual locations may correspond to any loudspeaker layout, such as a standard 5.1 speaker layout or a speaker layout with surround channels more to the sides of the listener. The center filter 508 filters the center channel signal $C_{OUT}$ to sound as if it is emanating from a center speaker in front of the listener. The left front filter 510 filters the result of GL1 to sound as if it is emanating from a speaker in front and to the left of the listener. The right front filter 512 filters the result of GR1 to sound as if it is emanating from a speaker in front and to the right of the listener. The left surround filter 514 filters the result of GL2 to sound as if it is emanating from a speaker to the left side of the listener. The right surround filter 516 filters the result of GR2 to sound as if it is emanating from a speaker to the right side of the listener. The center, left front, right front, left surround, and right surround filters (508, 510, 512, 514, 516) may utilize a topology similar to the example topology shown in FIG. 4A.

While a layout having side surround virtual loudspeakers is described above, the filters may be modified to give the impression that the audio signals are emanating from any location. For example, a more standard 5.1 speaker layout may be used, where the left surround filter 514 filters the result of GL2 to sound as if it is emanating from a speaker behind and to the left of the listener, and the right surround filter 516 filters the result of GR2 to sound as if it is emanating from a speaker behind and to the right of the listener.

In accordance with a particular embodiment, the values of the left and right scalars (GL1, GL2, GR1, GR2) are linked. The values may be chosen so that the total amplitude of each pair equals one (i.e., GL1+GL2=1), or the values may be chosen so that the total energy of each pair equals one (i.e., $\sqrt{GL1^2+GL2^2}=1$). Preferably, the value of GL1 equals the value of GR1, and the value of GL2 equals the value of GR2, in order to maintain left-right balance. The values of GL1 and GL2 determine how much of the audio signal is directed to a left front audio channel or to a left surround audio channel. The values of GR1 and GR2 determine how much of the audio signal is directed to a right front audio channel or to a right surround audio channel. As the values of GL2 and GR2 increase, the audio content is virtually panned from in front of the listener to the sides (or behind) of the listener.

By anchoring center-panned audio components in front of listener (with GC1 and GC2), and by directing hard-panned audio components more to the sides of the listener (with GL1, GL2, GR1, and GR2), the listener may have an improved listening experience over headphones. How far to the sides of the listener the audio content is directed may be easily adjusted by modifying GL1, GL2, GR1, and GR2. Also, how much audio content is anchored in front of the listener may be easily adjusted by modifying GC1 and GC2. These adjustments may give a listener the impression that the audio content is coming from outside of the listener's head, while maintaining the strong left-right separation that a listener expects with headphones.

Figure 6:
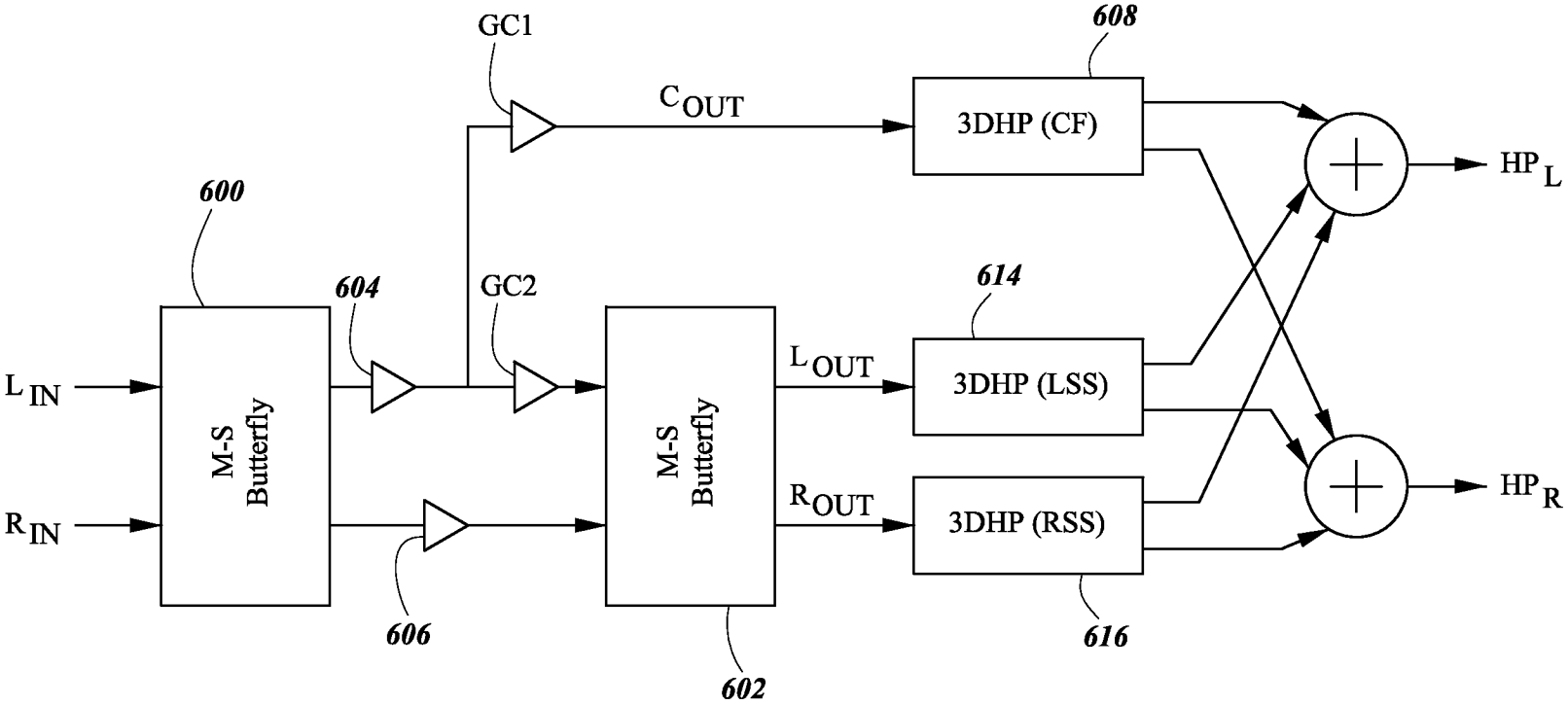
FIG. 6 illustrates another embodiment of a headphone virtualization system.

FIG. 6 illustrates another embodiment of a headphone virtualization system. In contrast to the systems of FIGS. 4 and 5, the system of FIG. 6 utilizes center and surround filters, without the use of front filters. The headphone virtualization system of FIG. 6 includes an input stage as shown in FIG. 3. The input stage includes a pair of M-S butterfly matrices 600 and 602, M and S scalars 604 and 606, and two center scalars GC1 and GC2. The center channel signal $C_{OUT}$ from the input stage is fed to a center filter 608. The left channel signal $L_{OUT}$ from the input stage is fed to a left surround filter 614. The right channel signal $R_{OUT}$ from the input stage is fed to a right surround filter 616. The outputs of the center filter 608, left surround filter 614, and right surround filter 616 are then combined into a left headphone signal $HP_L$ and a right headphone signal $HP_R$. The left headphone signal $HP_L$ and the right headphone signal $HP_R$ may then be connected to headphones or other loudspeakers for playback of the audio content.

The center, left side, and right side filters (608, 614, 616) utilize HRTFs to give a listener the impression that the audio signals are emanating from certain virtual locations when the audio signals are played back over headphones. The center filter 608 filters the center channel signal $C_{OUT}$ to sound as if it is emanating from a center speaker in front of the listener. The left surround filter 614 filters the left channel signal $L_{OUT}$ to sound as if it is emanating from a speaker to the left side of the listener. The right surround filter 616 filters the right channel signal $R_{OUT}$ to sound as if it is emanating from a speaker to the right side of the listener. The center, left surround, and right surround filters (608, 614, 616) may utilize a topology similar to the example topology shown in FIG. 4A.

In contrast to the embodiment of FIG. 5, the system of FIG. 6 does not utilize left and right scalars GL1, GL2, GR1, and GR2. Instead, the left surround filter 614 and right surround filter 616 are configured to virtualize $L_{OUT}$ and $R_{OUT}$ to any location to the left and right sides of the listener, as determined by the parameters of the left surround filter 614 and right surround filter 616.

Figure 7:
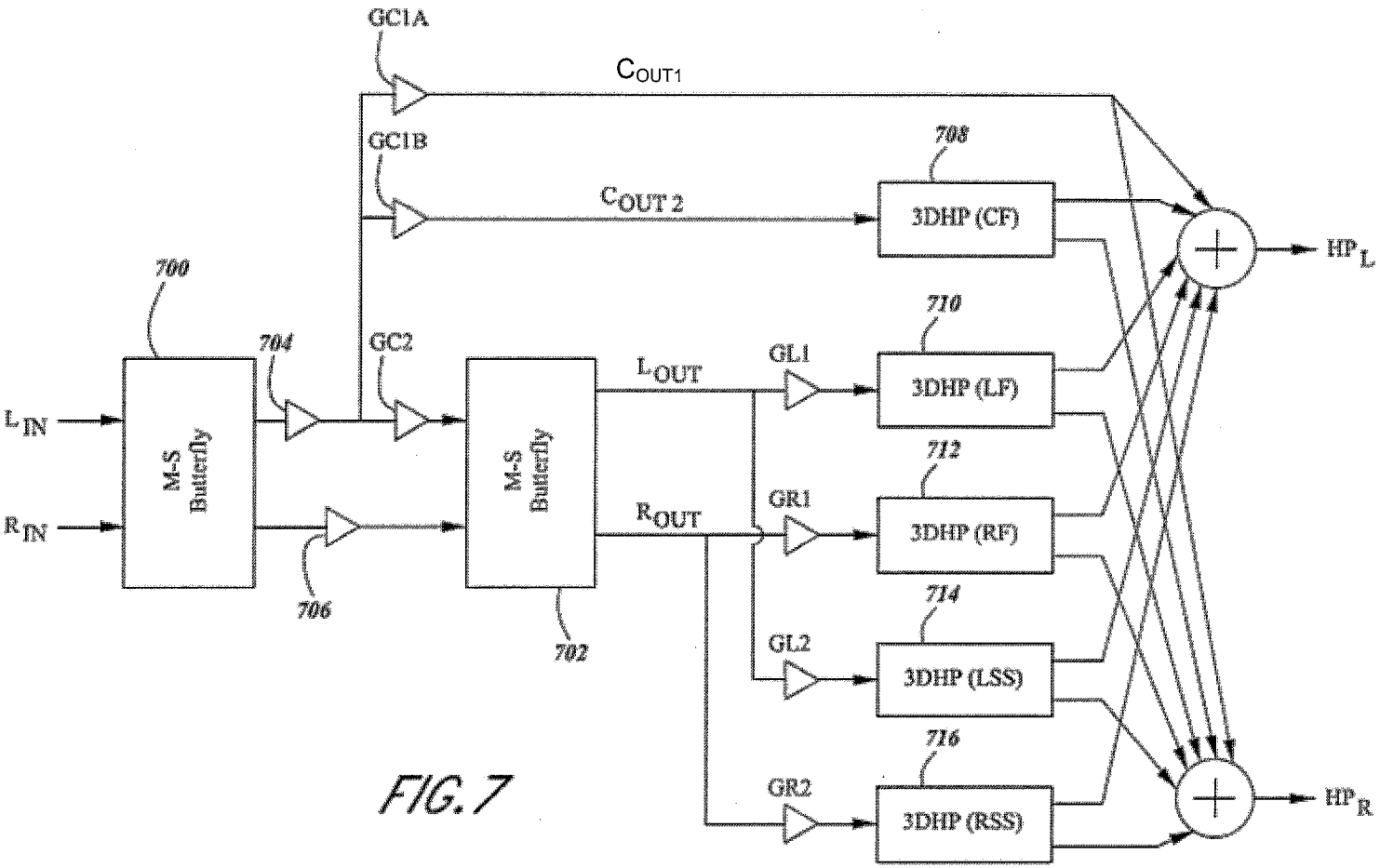
FIG. 7 illustrates another embodiment of a headphone virtualization system.

FIG. 7 illustrates another embodiment of a headphone virtualization system. In contrast to the system of FIG. 5, the input stage of the system of FIG. 7 has been modified to generate a "dry" center channel component $C_{OUT1}$. As in FIG. 3, the M and S outputs of a first M-S butterfly matrix 700 are connected to two scalars 704 and 706. The scalars 704 and 706 may have a value of ½, or may be adjusted to other values. After the gain is adjusted by the mid "M" output scalar 704, the signal is directed through three center scalars GC1A, GC1B and GC2. The result of the first center scalar GC1A is output as a dry center channel signal $C_{OUT1}$. The dry center signal $C_{OUT1}$ is a scaled version of the mid signal "M" (i.e., $L_{IN}+R_{IN}$) and is downmixed directly with the left and right output signals. The result of the second center scalar GC1B is fed to a center filter 708. And the result of the third center scalar GC2 is input to a second M-S butterfly matrix 702. The second M-S butterfly matrix 702 outputs left channel signal $L_{OUT}$ and a right channel signal $R_{OUT}$.

In accordance with a particular embodiment, the values of the three center scalars GC1A, GC1B, and GC2 are linked. The values may be chosen so that the total amplitude of GC1A, GC1B, and GC2 equals one (i.e., GC1A+GC1B+GC2=1) or the values may be chosen so that the total energy of GC1A, GC1B, and GC2 equals one (i.e., $\sqrt{GC1A^2+GC1B^2+GC2^2}=1$). The values of GC1A, GC1B, and GC2 determine how much of the audio signal is directed to a dry center channel $C_{OUT1}$, how much is directed to a dedicated center channel $C_{OUT2}$, and how much remains as a "phantom" center channel (i.e., a component of $L_{OUT}$ and $R_{OUT}$). A larger GC2 means more of the audio signal is directed to a phantom center channel. A larger GC1A means more of the audio signal is directed to the dry center channel $C_{OUT1}$. And a larger GC1B means more of the audio signal is directed to the dedicated center channel $C_{OUT2}$. The $C_{OUT2}$, $L_{OUT}$, and $R_{OUT}$ signals may then be processed further, as described below.

The headphone virtualization system of FIG. 7 includes a virtualizer stage similar to the virtualizer stage of FIG. 5. The left channel signal $L_{OUT}$ from the input stage is directed to two left scalars GL1 and GL2. The result of the first left scalar GL1 is fed to a left front filter 710, and the result of the second left scalar GL2 is fed to a left surround filter 714. The right channel signal $R_{OUT}$ from the input stage is directed to two right scalars GR1 and GR2. The result of the first right scalar GR1 is fed to a right front filter 712, and the result of the second right scalar GR2 is fed to a right surround filter 716. The dry center channel component $C_{OUT1}$ and the outputs of the center filter 708, left front filter 710, right front filter 712, left surround filter 714, and right surround filter 716 are then combined into a left headphone signal $HP_L$ and a right headphone signal $HP_R$. The left headphone signal $HP_L$ and the right headphone signal $HP_R$ may then be connected to headphones or other loudspeakers for playback of the audio content.

The center, left front, right front, left surround, and right surround filters (708, 710, 712, 714, 716) can utilize HRTFs to give a listener the impression that the audio signals are emanating from certain virtual locations when the audio signals are played back over headphones. The virtual locations may correspond to any loudspeaker layout, such as a standard 5.1 speaker layout or a speaker layout with surround channels more to the sides of the listener. The center filter 708 filters the dedicated center channel signal $C_{OUT2}$ to sound as if it is emanating from a center speaker in front of the listener. The left front filter 710 filters the result of GL1 to sound as if it is emanating from a speaker in front and to the left of the listener. The right front filter 712 filters the result of GR1 to sound as if it is emanating from a speaker in front and to the right of the listener. The left surround filter 714 filters the result of GL2 to sound as if it is emanating from a speaker to the left side of the listener. The right surround filter 716 filters the result of GR2 to sound as if it is emanating from a speaker to the right side of the listener. The center, left front, right front, left surround, and right surround filters (708, 710, 712, 714, 716) may utilize a topology similar to the example topology shown in FIG. 4A.

While a layout having side surround virtual loudspeakers is described above, the filters may be modified to give the impression that the audio signals are emanating from any location. For example, a more standard 5.1 speaker layout may be used, where the left surround filter 714 filters the result of GL2 to sound as if it is emanating from a speaker behind and to the left of the listener, and the right surround filter 716 filters the result of GR2 to sound as if it is emanating from a speaker behind and to the right of the listener.

As described above in reference to FIG. 5, the values of the left and right scalars (GL1, GL2, GR1, GR2) may be linked. The values may be chosen so that the total amplitude of each pair equals one (i.e., GL1+GL2=1), or the values may be chosen so that the total energy of each pair equals one (i.e., $\sqrt{GL1^2+GL2^2}=1$). Preferably, the value of GL1 equals the value of GR1, and the value of GL2 equals the value of GR2. The values of GL1 and GL2 determine how much of the audio signal is directed to a left front audio channel or to a left surround audio channel. The values of GR1 and GR2 determine how much of the audio signal is directed to a right front audio channel or to a right surround audio channel. As the values of GL2 and GR2 increase, the audio content is virtually panned from in front of the listener to the sides (or behind) of the listener.

By anchoring center-panned audio components in front of listener (with GC1A, GC1B, and GC2), and by directing hard-panned audio components more to the sides of the listener (with GL1, GL2, GR1, and GR2), the listener may have an improved listening experience over headphones. How far to the sides of the listener the audio content is directed may be easily adjusted by modifying GL1, GL2, GR1, and GR2. Also, how much audio content is anchored in front of the listener may be easily adjusted by modifying GC1A, GC1B, and GC2. The dry center channel component $C_{OUT1}$ may further adjust the apparent depth of the center channel. A larger GC1A may place the center channel more in the head of the listener, while a larger GC1B may place the center channel more in front of the listener. These adjustments may give a listener the impression that the audio content is coming from outside of the listener's head, while maintaining the strong left-right separation that a listener expects with headphones.

While the above embodiments are described primarily with an application to headphone listening, it should be understood that the embodiments may be easily modified to apply to a pair of loudspeakers. In such embodiments, the left front, right front, center, left surround, and right surround filters may be modified to utilize filters that correspond to stereo loudspeaker reproduction instead of headphones. For example, a stereo crosstalk canceller may be applied to the output of the headphone filter topology. Alternatively, other well-known loudspeaker-based virtualization techniques may be applied. The result of these filters (and optionally a dry center signal) may then be combined into a left speaker signal and a right speaker signal. Similarly to the headphone virtualization embodiments, the center scalars (GC1 and GC2) may adjust the amount of audio content directed to a virtual center channel loudspeaker versus a phantom center channel, and the left and right scalars (GL1, GL2, GR1, and GR2) may adjust amount of audio content directed to virtual loudspeakers to the sides of the listener. These adjustments may give a listener the impression that the audio content has a wider stereo image when the content is played over stereo loudspeakers.

IV. Additional Embodiments

In certain embodiments, any of the HRTFs described above can be derived from real binaural room impulse response measurements for accurate "speakers in a room" perception or they can be based on models (e.g., a spherical head model). The former HRTFs can be considered to more accurately represent a hearing response for a particular room, whereas the latter modeled HRTFs may be more processed. For example, the modeled HRTFs may be averaged versions or approximations of real HRTFs.

In general, real HRTF measurements may be more suitable for listeners (including many older listeners) who prefer the in-room loudspeaker listening experience over headphones. The modeled HRTF measurements can affect the audio signal equalization more subtly than the real HRTFs and may be more suitable for consumers (such as younger listeners) that wish to have an enhanced (yet not fully out of head) version of a typical headphone listening experience. Another approach could include a hybrid of both HRTF models, where the HRTFs applied to the front channels are using real HRTF data and the HRTFs applied to the side (or rear) channels use modeled HRTF data. Alternatively, the front channels may be filtered with modeled HRTFs and the side (or rear) channels may be filtered with real HRTFs.

Although described herein as "real" HRTFs, the "real" HRTFs can also be considered modeled HRTFs in some embodiments, just less modeled than the "modeled" HRTFs. For instance, the "real" HRTFs may still be approximations to HRTFs in nature, yet may be less approximate than the modeled HRTFs. The modeled HRTFs may have more averaging applied, or fewer peaks, or fewer amplitude deviations (e.g., in the frequency domain) than the real HRTFs. Thus, the real HRTFs can thus be considered to be more accurate HRTFs than the modeled HRTFs. Said another way, some HRTFs applied in the processing described herein can be more modeled or averaged than other HRTFs. HRTFs with less modeling than other HRTFs can be perceived to create a more out-of-head listening experience than other HRTFs.

Figure 8:
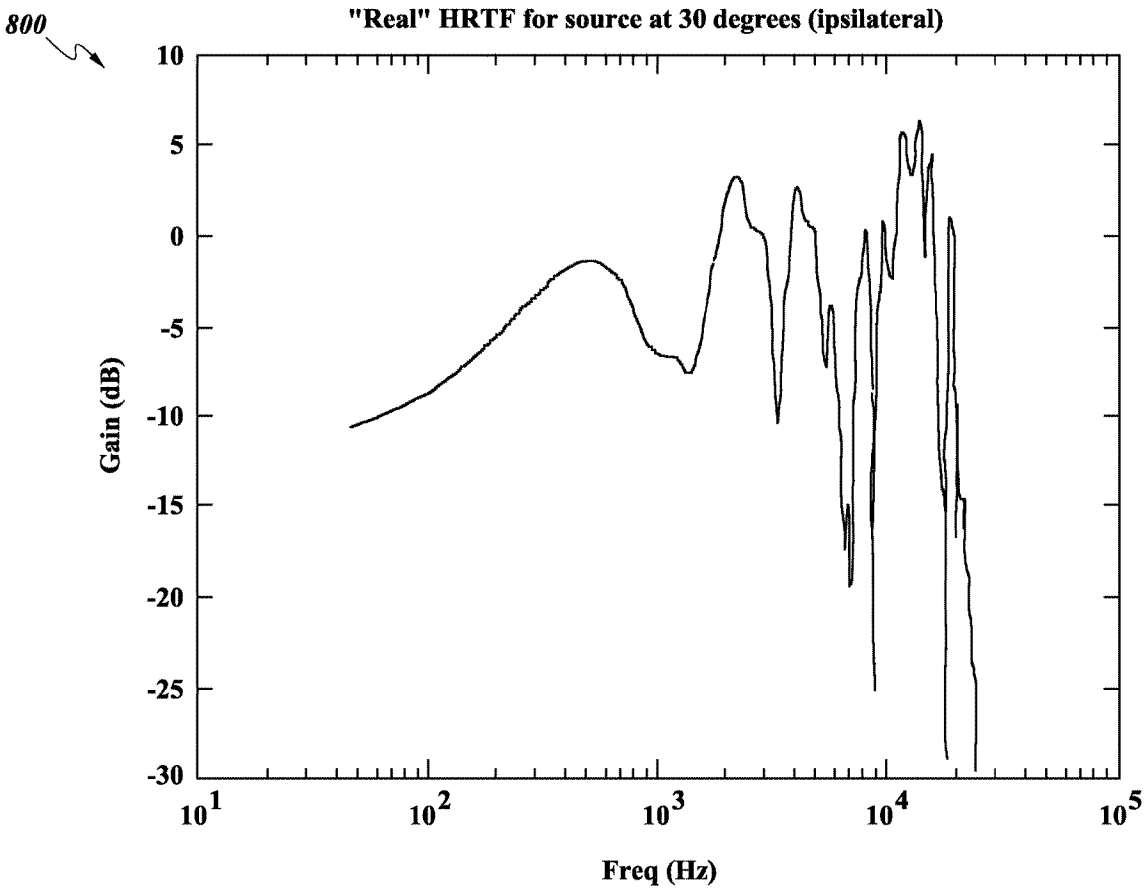
FIGS. 8 through 15 depict example head-related transfer functions that may be used in any of the virtualization systems described herein.
Figure 9:
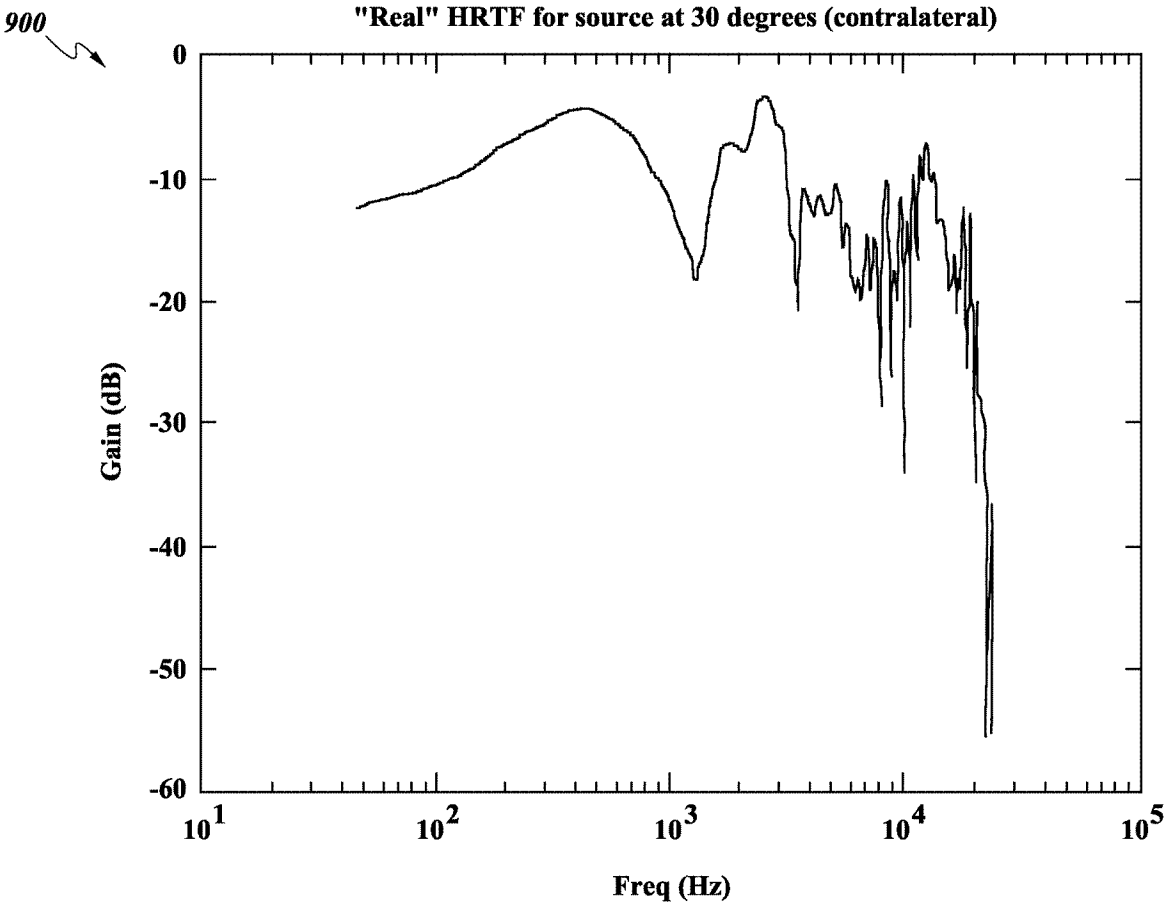
Figure 10:
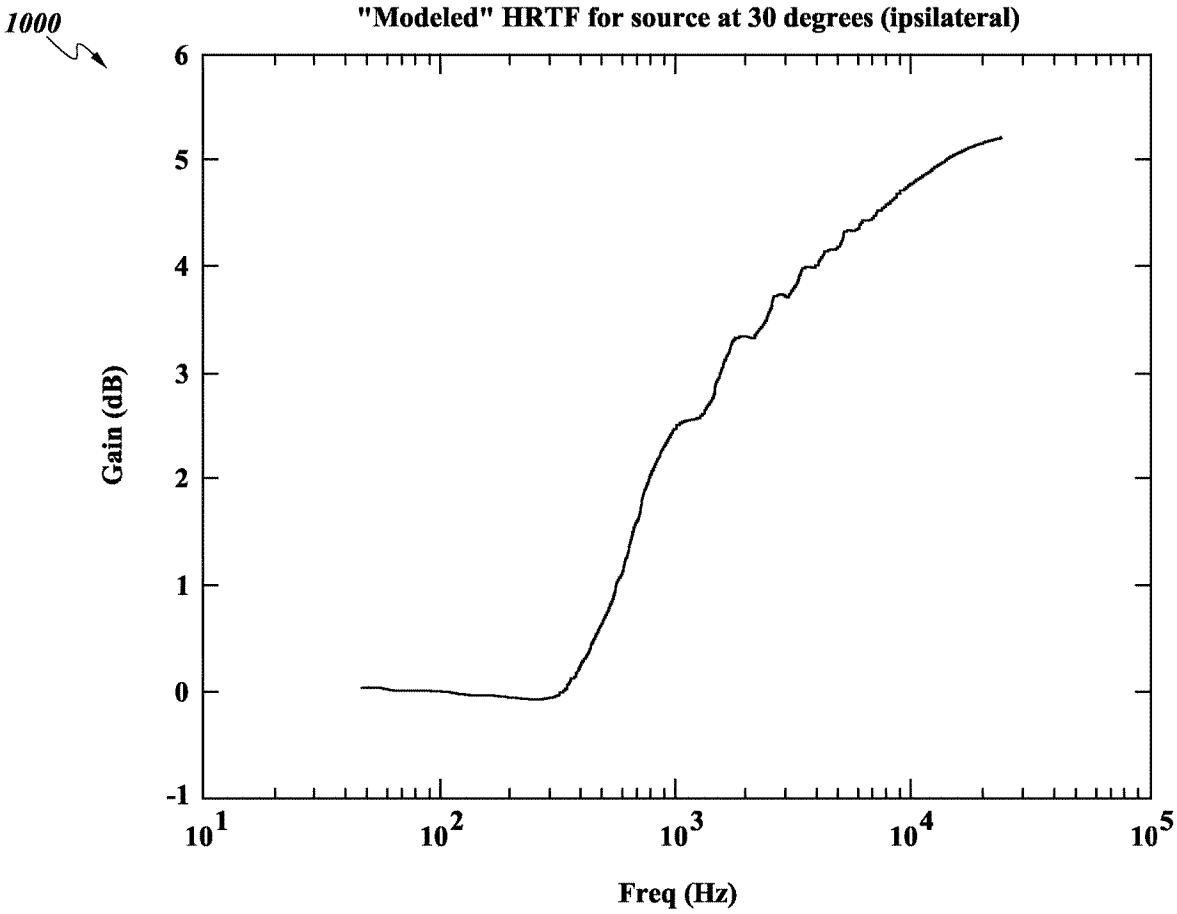
Figure 11:
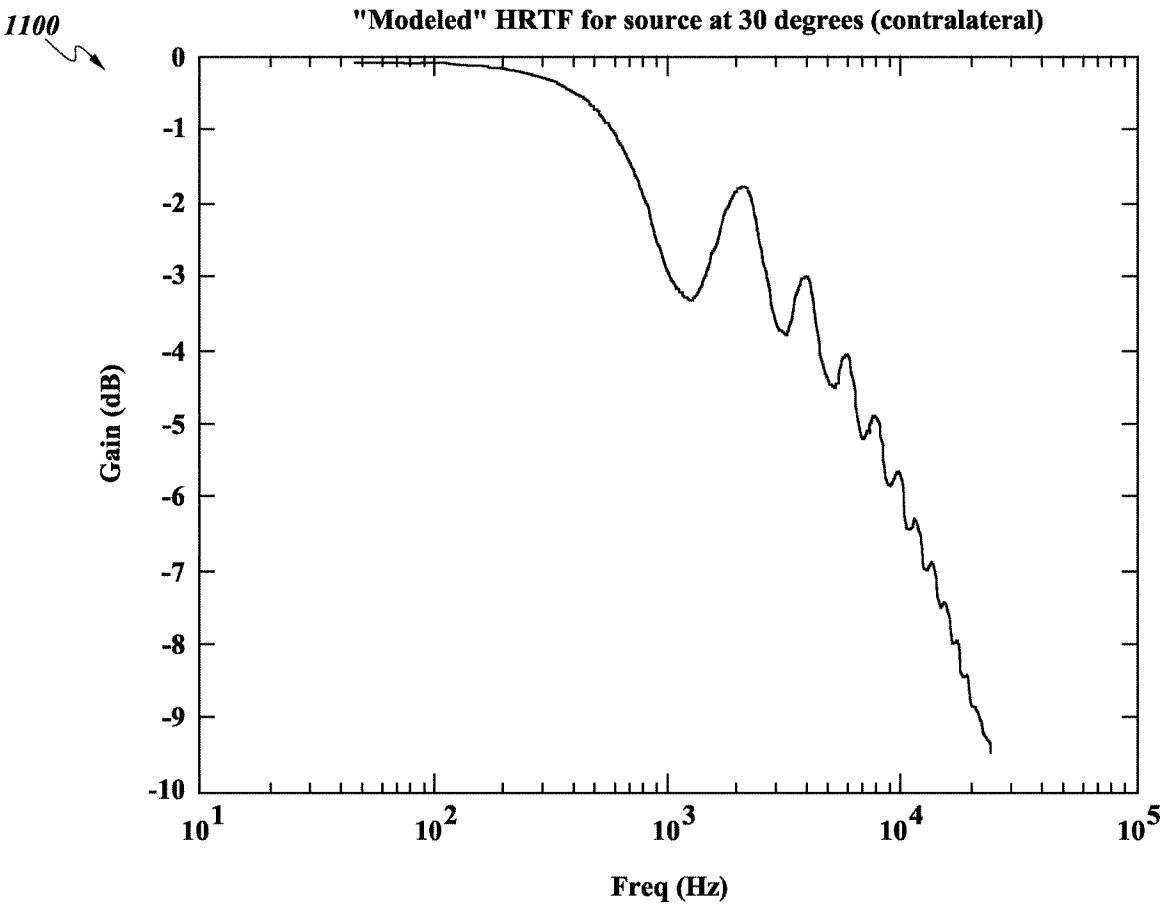

Some examples of real and modeled HRTFs are shown with respect to plots 800 through 1500 in FIGS. 8 through 15. For instance, FIGS. 8 and 9 show example real ipsilateral and contralateral HRTFs for a sound source at 30 degrees, respectively. FIGS. 10 and 11 show example modeled ipsilateral and contralateral HRTFs for a sound source at 30 degrees, respectively. The contrast between the example real HRTFs and the example modeled HRTFs is strong, with the real HRTFs having more and deeper peaks and valleys than the modeled HRTFs. Further, the modeled ipsilateral HRTF in FIG. 10 has a generally upward trend as frequency increases, while the real ipsilateral HRTF in FIG. 8 has more pronounced peaks and valleys and final attenuation as frequency increases. The real contralateral HRTF in FIG. 9 and the modeled contralateral HRTF in FIG. 11 both have a downward trend, but the peaks and valleys of the real contralateral HRTF are deeper and greater in number than with the modeled contralateral HRTF. Further, differences in starting and ending (as well as other) gain values also exist between the real and modeled HRTFs in FIGS. 9 through 11, as is apparent from the FIGURES.

Figure 12:
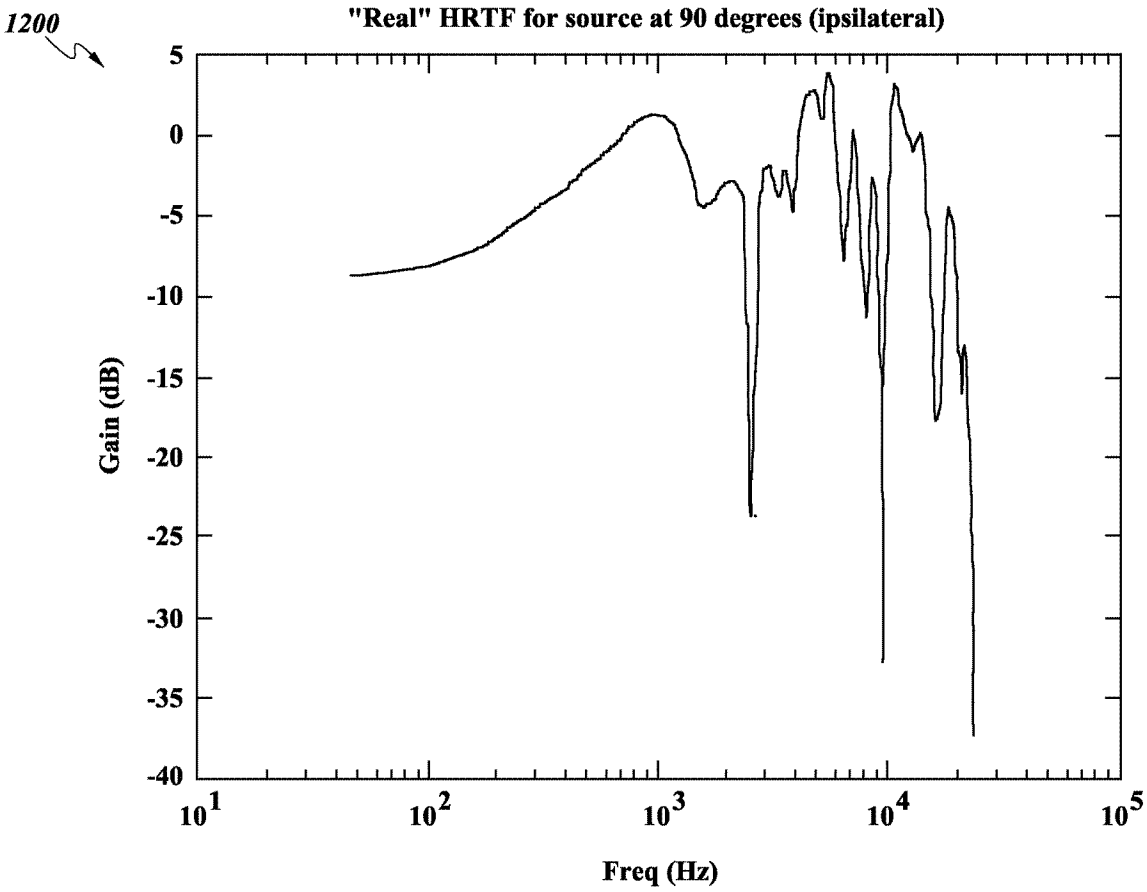
Figure 13:
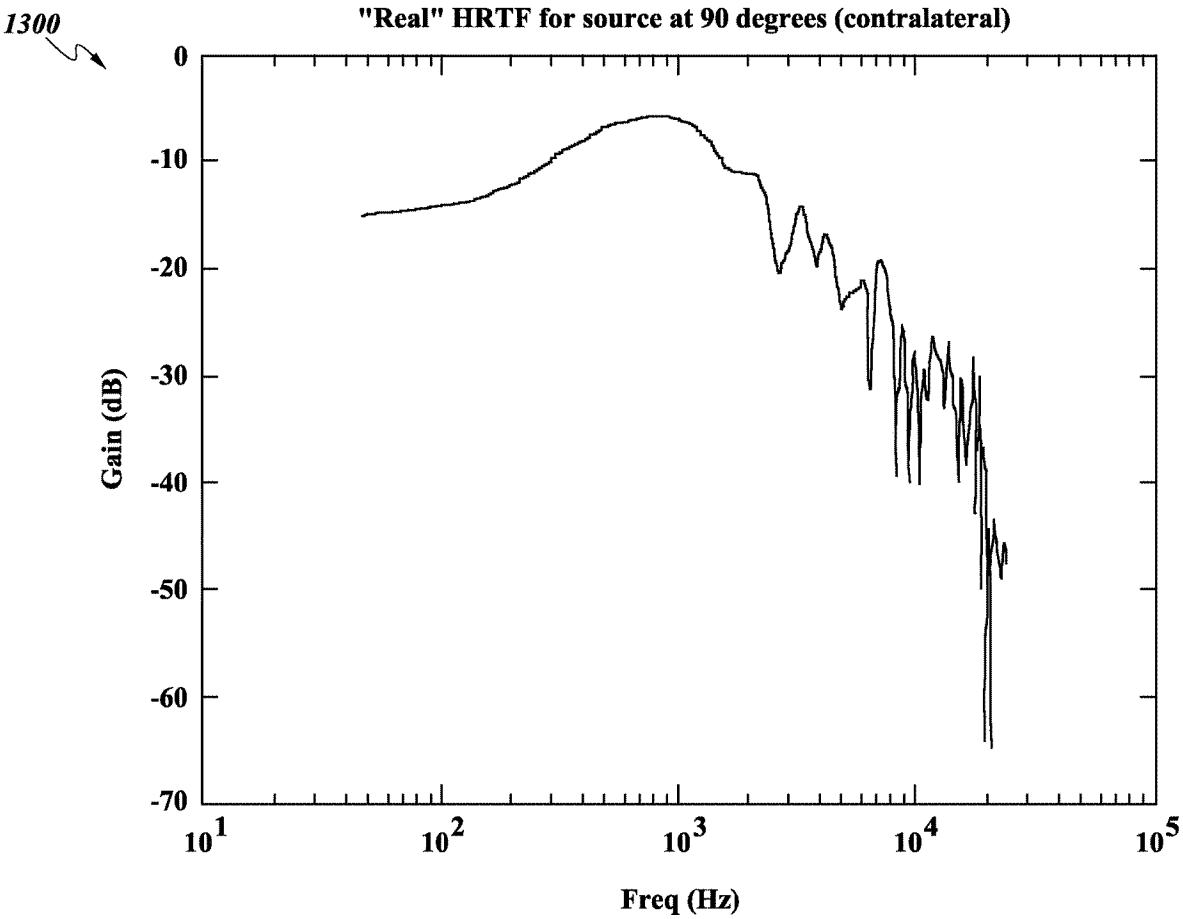
Figure 14:
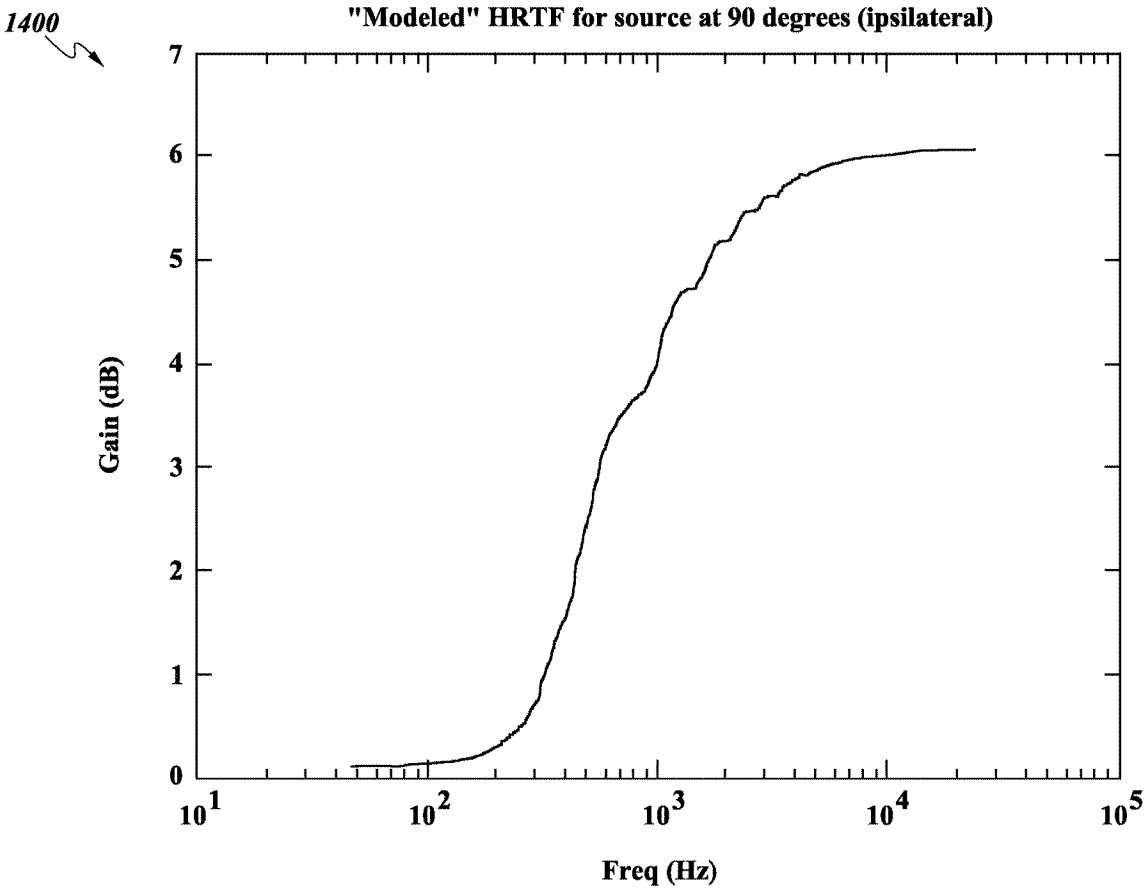
Figure 15:
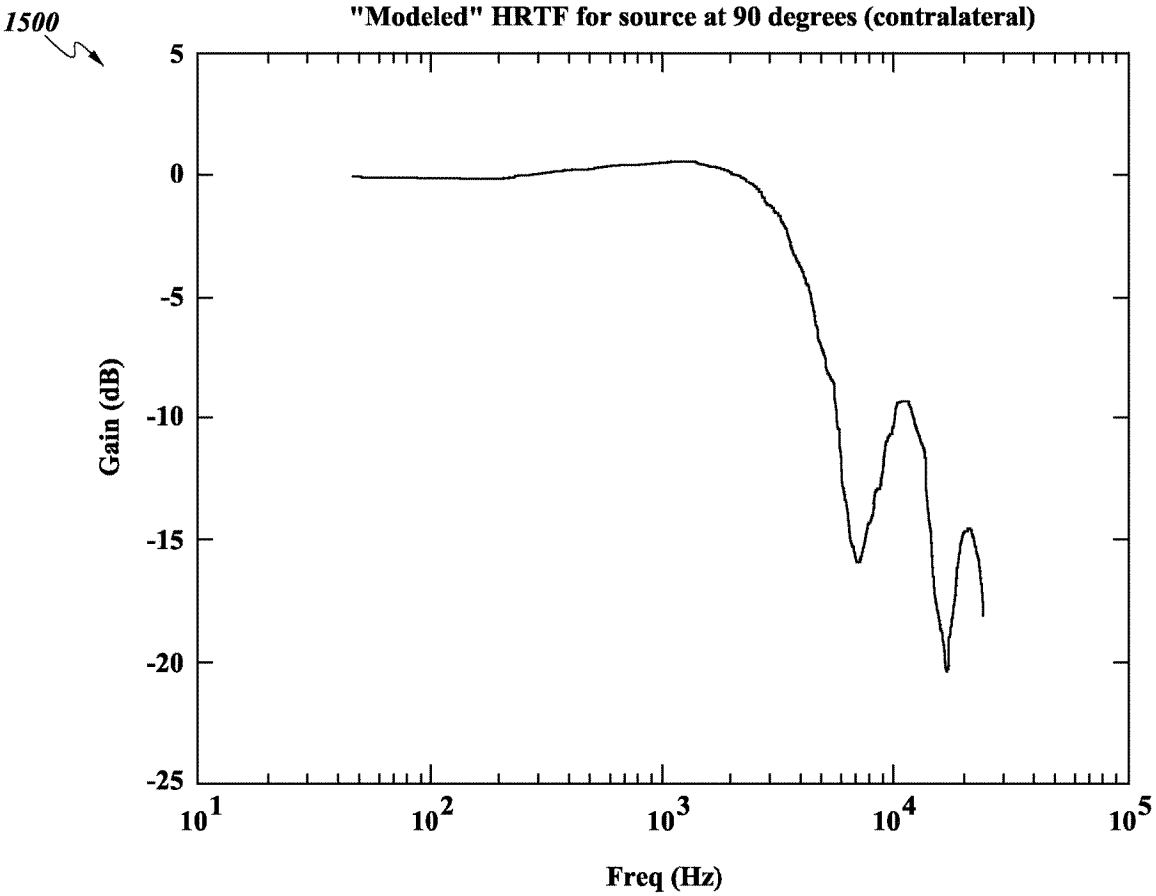

Similar insights may be gained by comparing the real and modeled HRTFs shown in FIGS. 12 through 15. FIGS. 12 and 13 show example real ipsilateral and contralateral HRTFs for a sound source at 90 degrees, while FIGS. 14 and 15 show example modeled ipsilateral and contralateral HRTFs for a sound source at 90 degrees, respectively. As with FIGS. 8 through 11, the modeled HRTFs in FIGS. 14 and 15 manifest more roundedness, averaging, or modeling than the real HRTFs in FIGS. 12 and 13. Likewise, starting and ending gain values differ.

The HRTFs (or HRIR equivalents) shown in FIGS. 8 through 15 may be used as example filters for any of the HRTFs (or HRIRs) described above. However, the example HRTFs shown represent responses associated with a single room, and other HRTFs may be used instead for other rooms. The system may also store multiple different HRTFs for multiple different rooms and provide a user interface that enables a user to select an HRTF for a desired room.

Ultimately, embodiments described herein can facilitate providing listeners who are used to an in-head listening experience of traditional headphones with a more out-of-head listening experience. At the same time, this out-of-head listening experience may be tempered so as to be less out-of-head than a full out-of-head virtualization approach that might be appreciated by listeners who prefer a stereo loudspeaker experience. Parameters of the virtualization approaches described herein, including any of the gain parameters described above, may be varied to adjust between a full out-of-head experience and a fully (or partially) in-head experience.

In still other embodiments, additional channels may be added to any of the systems described above. Providing additional channels can facilitate smoother panning transitions from one virtual speaker location to another. For example, two additional channels can be added to FIG. 5 or 7 to create 7 channels to which a virtualization filter (with an appropriate HRTF) may each be applied. Currently, FIGS. 5 and 7 include filters for simulating front and side speakers, and the two new channels could be filtered to create two intermediate virtual speakers, one on each side of the listener's head and between the front and side channels. Panning can then be performed from front to intermediate to side speakers and vice versa. Any number of channels can be included in any of the systems described above to pan in any virtual direction around a listener's head. Further, it should be noted that any of the features described herein can be used together with any subcombination of the features described in U.S. application Ser. No. 14/091,112, filed Nov. 26, 2013, titled "Method and Apparatus for Personalized Audio Virtualization," the disclosure of which is hereby incorporated by reference in its entirety.

V. Terminology

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show particulars of the present invention in more detail than is necessary for the fundamental understanding of the present invention, the description taken with the drawings making apparent to those skilled in the art how the several forms of the present invention may be embodied in practice.

What is claimed is:

1. A method comprising:

under control of a hardware processor:

receiving left and right audio channels;

combining at least a portion of the left audio channel with at least a portion of the right audio channel to produce a center channel, the center channel comprising a first portion to be filtered and a second portion not to be filtered;

deriving left and right audio signals at least in part from the center channel;

applying a first virtualization filter comprising a first head-related transfer function to the left audio signal to produce a virtualized left channel;

applying a second virtualization filter comprising a second head-related transfer function to the right audio signal to produce a virtualized right channel;

applying a third virtualization filter comprising a third head-related transfer function to the first portion of the center channel to produce a virtualized center channel;

mixing the virtualized center channel, the second portion of the center channel, and the virtualized left and right channels to produce left and right output signals; and outputting the left and right output signals to headphone speakers for playback over the headphone speakers.

2. The method of claim 1, further comprising applying first and second gains to the center channel to produce a first scaled center channel and a second scaled center channel.

3. The method of claim 2, further comprising using the second scaled center channel to perform said deriving.

4. The method of claim 3, wherein values of the first and second gains are linked based on amplitude or energy.

5. A method comprising:

under control of a hardware processor:

processing a two channel audio signal comprising two audio channels to generate three or more processed audio channels, the three or more processed audio channels comprising a left channel, a right channel, and a center channel, the center channel derived from a combination of the two audio channels of the two channel audio signal;

applying each of the processed audio channels to the input of a virtualization system;

applying one or more virtualization filters of the virtualization system to the left channel, the right channel, and a first portion of the center channel to produce a virtualized left channel, a virtualized right channel, and a virtualized center channel;

combining the virtualized left channel, the virtualized right channel, the virtualized center channel, and a second portion of the center channel to produce a virtualized two channel signal; and outputting the virtualized two channel audio signal for playback on headphones.

6. The method of claim 5, wherein said processing the two channel audio signal further comprises deriving the left channel and the right channel at least in part from the center channel.

7. The method of claim 6, further comprising applying first and second gains to the center channel to produce a first scaled center channel and a second scaled center channel, and wherein said processing further comprises deriving the left and right channels from the second scaled center channel.

8. The method of claim 7, wherein values of the first and second gains are linked.

9. The method of claim 8, wherein values of the first and second gains are linked based on amplitude.

10. The method of claim 8, wherein values of the first and second gains are linked based on energy.

11. A system comprising:

a hardware processor configured to:

receive left and right audio signals;

process the left and right audio signals to generate three or more processed audio signals, the three or more processed audio signals comprising a left audio signal, a right audio signal, and a center audio signal;

filter each of the left and right audio signals with one or more first virtualization filters to produce filtered left and right signals;

filter a first portion of the center audio signal with a second virtualization filter to produce a filtered center signal, without filtering a second portion of the center audio signal;

combine the filtered left signal, filtered right signal, filtered center signal, and the second portion of the center audio signal to produce left and right output signals; and output the filtered left and right output signals.

12. The system of claim 11, wherein the one or more virtualization filters comprise two head-related impulse responses for each of the three or more processed audio signals.

13. The system of claim 11, wherein the one or more virtualization filters comprise a pair of ipsilateral and contralateral head-related transfer functions for each of the three or more processed audio signals.

14. The system of claim 11, wherein the three or more processed audio signals comprise five processed audio signals.

15. The system of claim 14, wherein the hardware processor is configured to apply at least the following filters to the five processed signals: a left front filter, a right front filter, a left surround filter, and a right surround filter.

16. The system of claim 15, wherein the hardware processor is further configured to apply gains to at least some of the inputs to the left front filter, the right front filter, the left surround filter, and the right surround filter.

17. The system of claim 16, wherein values of the gains are linked.

18. The system of claim 17, wherein values of the gains are linked based on amplitude.

19. The system of claim 17, wherein values of the gains are linked based on energy.

* * * * *